US005867193A

United States Patent [19]

Yasuhara

[11] Patent Number: 5,867,193

[45] Date of Patent: Feb. 2, 1999

[54] INK-JET PRINTING HEAD HAVING PIEOZOELECTRIC BLOCKS WITH ELECTRODES ON ENDS PERPENDICULAR TO AXIAL DIRECTION OF BORES

[75] Inventor: Masatoshi Yasuhara, Tokyo, Japan

[73] Assignee: NEC Corporation, Japan

[21] Appl. No.: 281,836

[22] Filed: Jul. 28, 1994

[30] Foreign Application Priority Data

Jul. 30, 1993 [JP] Japan ..... 5-189796

[51] Int. Cl.[6] ..... B41J 2/045; B41J 2/145

[52] U.S. Cl. ..... 347/68; 347/40

[58] Field of Search ..... 347/69, 68, 71, 347/40, 54, 72, 44, 47, 94; 310/365, 366, 367, 369

[56] References Cited

U.S. PATENT DOCUMENTS

| | | | |
|---|---|---|---|
| 3,211,088 | 10/1965 | Naiman | 347/68 |
| 3,786,517 | 1/1974 | Krause | 347/93 X |
| 4,418,354 | 11/1983 | Perduijn . | |
| 4,455,503 | 6/1984 | Nakatani | 310/368 |
| 4,752,788 | 6/1988 | Yasuhara et al. | 347/71 |
| 4,901,092 | 2/1990 | Moriyama | 347/68 |
| 5,189,437 | 2/1993 | Michaelis et al. | 347/47 |
| 5,252,994 | 10/1993 | Narita et al. | 347/69 |

FOREIGN PATENT DOCUMENTS

| | | | |
|---|---|---|---|
| 55-71572 | 5/1980 | Japan | 347/68 |
| 2-261072 | 10/1990 | Japan | 310/366 |
| 4-163152 | 6/1992 | Japan . | |

*Primary Examiner*—David F. Yockey

*Attorney, Agent, or Firm*—Ostrolenk, Faber, Gerb & Soffen, LLP

[57] ABSTRACT

An ink-jet printing head comprises at least one piezoelectric element block formed with a bore for storing ink and to which an electric voltage is supplied, and an ink supply member for supplying the ink to the bore of the piezoelectric element block. A droplet of ink is ejected from the bore with the aid of mechanical deformation of the piezoelectric element block produced when an electric voltage is supplied to the piezoelectric element block.

6 Claims, 7 Drawing Sheets

INK-JET PRINTING HEAD HAVING PIEOZOELECTRIC BLOCKS WITH ELECTRODES ON ENDS PERPENDICULAR TO AXIAL DIRECTION OF BORES

BACKGROUND OF THE INVENTION

1. Field of the Invention

The present invention relates to an ink-jet printing head and, more particularly, to a printing head of an ink-jet printing device using a piezoelectric element.

2. Description of the Prior Art

Generally, a conventional ink-jet printing device is provided with a printing head in which an piezoelectric element is used as a drive source, and an ink reservoir for storing ink. The printing head of the printing device comprises an ink chamber for temporarily storing the ink from the ink reservoir, a pressure chamber, and a piezoelectric element. The ink chamber supplies the ink to the pressure chamber, and a droplet of the ink is ejected from the nozzle of the pressure chamber with a pressure change. This pressure change is produced by actuation of the piezoelectric element on the pressure chamber. Japanese Patent Laid-Open Publication No. HEI 4-163152 published on 1992 discloses a stacked piezoelectric ceramic in which a plurality of piezoelectric ceramic plates is stacked through plane electrodes. A stacked piezoelectric ceramic such as that in Publication No. HEI 4-163152 has been recently used as a piezoelectric element.

In FIG. 1A showing prior art, a piezoelectric element 101 is fixed on a printing head 100 which has a pressure chamber 102. Ink 103 is supplied from an ink chamber (not shown) to the pressure chamber 102. When an electric voltage is applied to the piezoelectric element 101, the pressure chamber 102 is constricted by mechanical deformation of the piezoelectric element as shown in FIG. 1B and, consequently, the pressure in the pressure chamber 102 is increased, so that a droplet of ink is forcibly ejected. When actuation of the piezoelectric element 101 is stopped, the piezoelectric element 101 and the pressure chamber 102 are deformed in the opposite direction by inertia, as shown in FIGS. 1C and 1D, and, finally, they return to their original status, as shown in FIG. 1E. The piezoelectric element may be disposed surrounding a jet nozzle duct, as is described in U.S. Pat. No. 4,418,354.

The conventional printing head, however, has the drawback that the manufacturing cost is high because the pressure chamber or the jet nozzle and piezoelectric element must be manufactured separately and a plurality of piezoelectric elements must be installed individually at predetermined locations on a plurality of pressure chambers.

SUMMARY OF THE INVENTION

It is an object of the present invention to provide an improved printing head which is manufactured in low cost by integrating the pressure chamber and piezoelectric element.

The above object is accomplished in accordance with the present invention by providing an ink-jet printing head comprising at least one piezoelectric element block having a bore inside for storing ink and to which an electric voltage is supplied, and an ink supply member for supplying ink to the bore of the piezoelectric element block. A droplet of ink is ejected from the bore with the aid of mechanical deformation of the piezoelectric element block produced when the electric voltage is supplied to the piezoelectric element block.

According to the present invention, the piezoelectric element block functions as a pressure chamber for generating pressure with which a droplet of ink is ejected and also as a nozzle from which a droplet of ink is ejected.

The piezoelectric element block may be constituted by a stacked piezoelectric element block using a stacked ceramic.

BRIEF DESCRIPTION OF THE DRAWINGS

The drawbacks of a conventional ink-jet printing head and the features and advantages of an ink-jet printing head according to the present invention will be more clearly understood from the following description taken in conjunction the accompanying drawings in which.

DESCRIPTION OF THE PREFERRED EMBODIMENTS

Figure 1A:
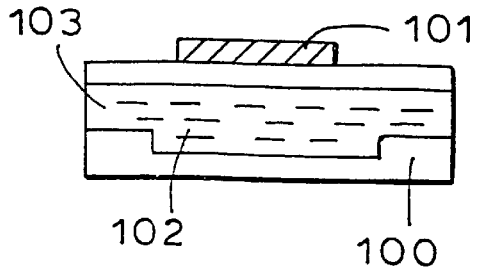
FIG. 1A PRIOR ART
FIGS. 1A to 1E are sectional views for explaining how ink is ejected from a conventional ink-jet printing head using a piezoelectric element.
Figure 1B:
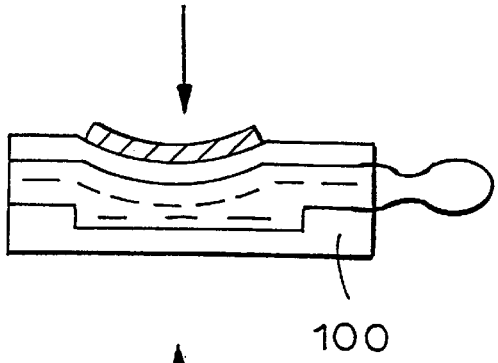
FIG. 1B PRIOR ART
Figure 1C:
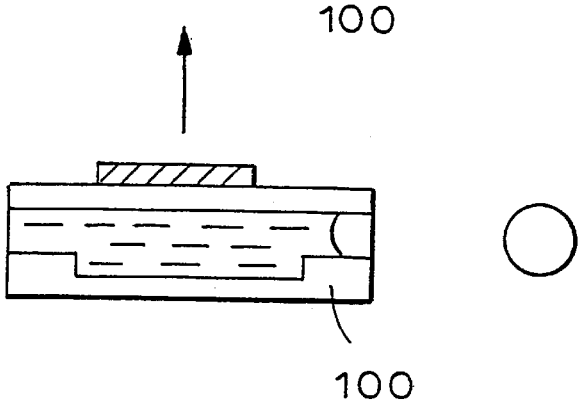
FIG. 1C PRIOR ART
Figure 1D:
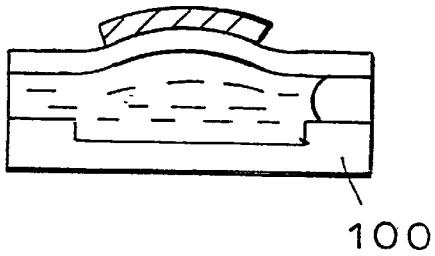
FIG. 1D PRIOR ART
Figure 1E:
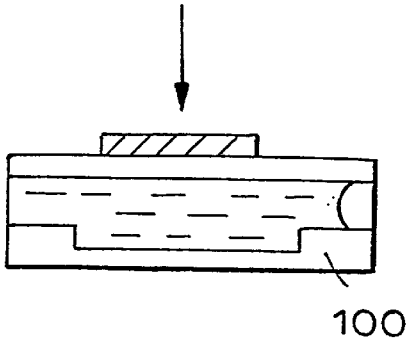
FIG. 1E PRIOR ART
Figure 2:
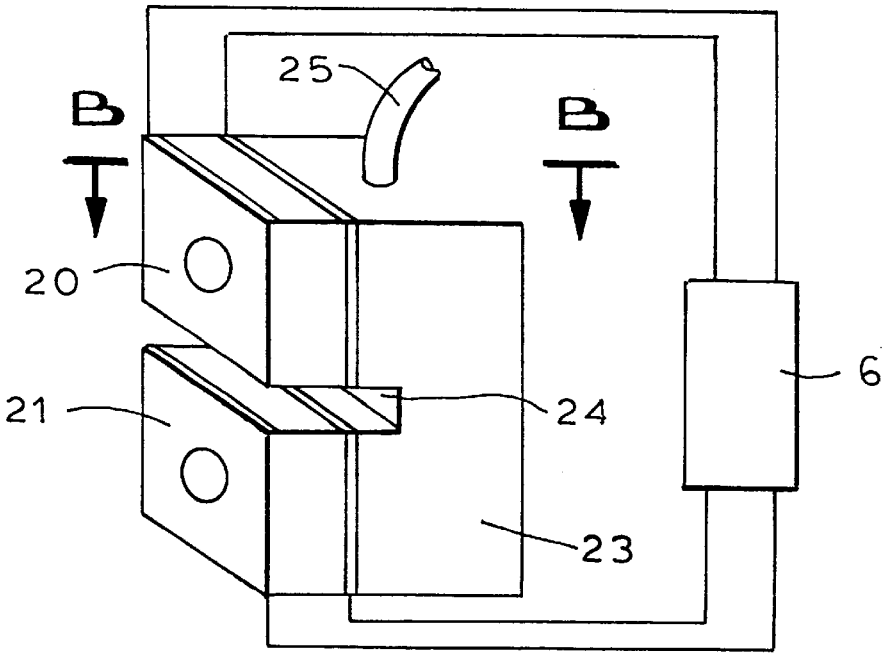
FIG. 2 is a perspective view showing an ink-jet printing head in accordance with an embodiment of the present invention.
Figure 3:
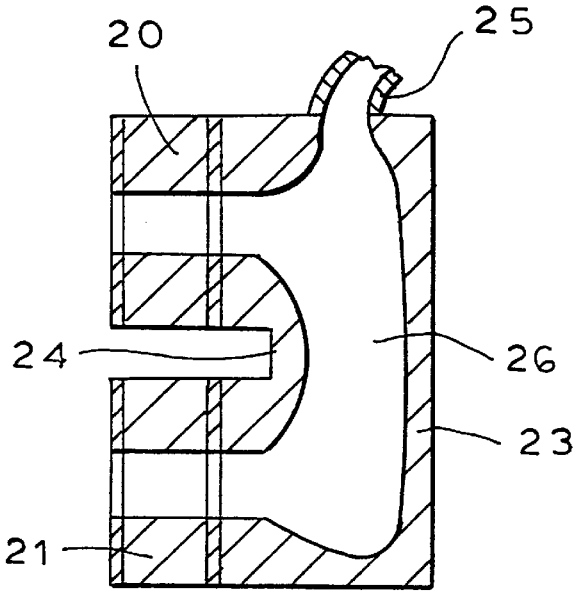
FIG. 3 is a sectional view of the ink-jet printing head taken substantially along line B—B in FIG. 2.

In FIGS. 2 and 3, there is shown a preferred embodiment of an ink-jet printing head in accordance with the present invention. The ink-jet printing head comprises a pair of piezoelectric element blocks 20 and 21 for ejecting a droplet of ink upon a drive signal from a drive circuit 6, and an ink supply member 23 provided inside it with an ink chamber 26. The piezoelectric element blocks 20 and 21 are rigidly secured on the ink supply 26 by means of an adhesive. Ink is supplied from an ink reservoir (not shown) to the ink chamber 26 through a pipe 25, and flows from the ink chamber 26 into a bore of the piezoelectric element blocks 20 and 21. The ink supply 23 is provided with a groove 24 so that mechanical deformation of one piezoelectric element block does not influence the other piezoelectric element block.

The drive circuit 6 is constituted such that a drive signal for driving the piezoelectric element blocks 20 and 21 is generated upon a print signal.

Figure 4B:
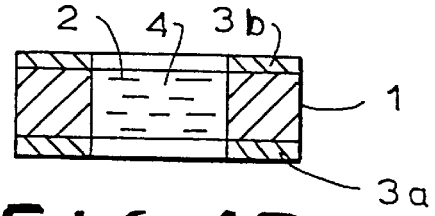
FIG. 4B is a sectional view of the piezoelectric element block taken substantially along line C—C in FIG. 4A.
Figure 4C:
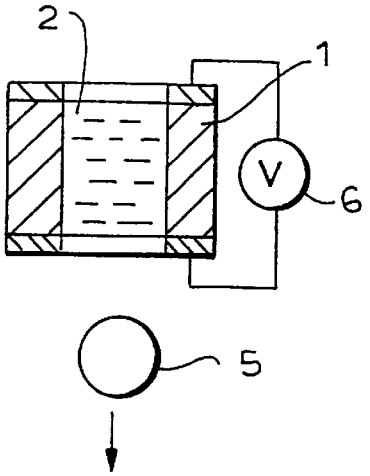
FIG. 4C is a sectional view showing how the piezoelectric element block in FIG. 4A is mechanically deformed when an electric voltage is applied to the block.
Figure 4A:
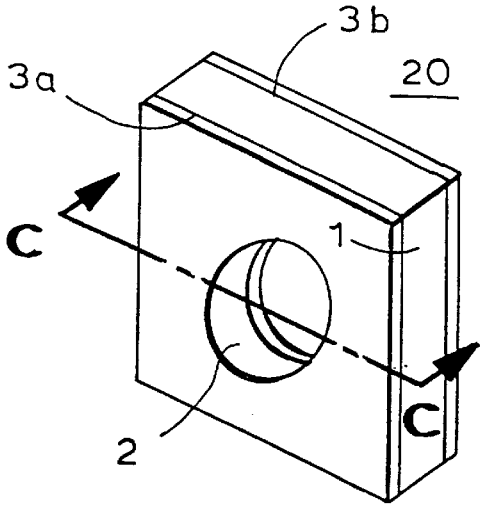
FIG. 4A is a perspective view showing an example of the piezoelectric element block of the ink-jet printing head shown in FIG. 2.

In FIGS. 4A and 4B, the piezoelectric element block 20 (or 21) comprises a piezoelectric element 1 provided at its center with a through bore 2 having a diameter 20 to 100 $\mu$m, and electrodes 3*a* and 3*b* on the opposite ends of the piezoelectric element 1 in the axial direction of the bore 2. The piezoelectric element block 20 is 20 to 500 $\mu$m thick. Electrodes 3*a* and 3*b* are respectively connected to the drive circuit 6, and the electrode 3*b* is rigidly secured on the ink supply member 23 by means of an adhesive. The through bore 2 communicates with the ink chamber 26, so that ink 4 in the ink chamber 26 is introduced into the through bore 2 by capillary action. If the ink 4 is a insulated oleaginous ink, it is unnecessary to coat an inner wall of the through bore 2 with an insulating film. However, if the ink 4 is not insulated, an insulating film must be formed inside the through bore 2 so as not to short the electrodes 3*a* and 3*b* via the ink 4.

Figure 5B:
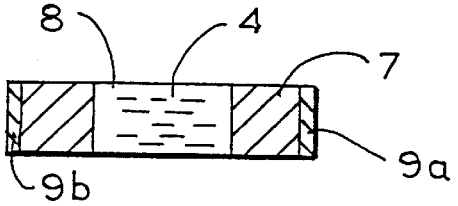
FIG. 5B is a sectional view of the piezoelectric element block taken substantially along line D—D in FIG. 5A.
Figure 5A:
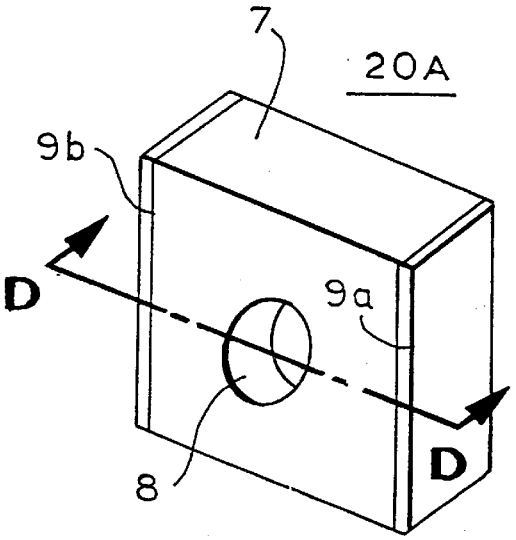
FIG. 5A is a perspective view showing a second example of the piezoelectric element block.
Figure 5C:
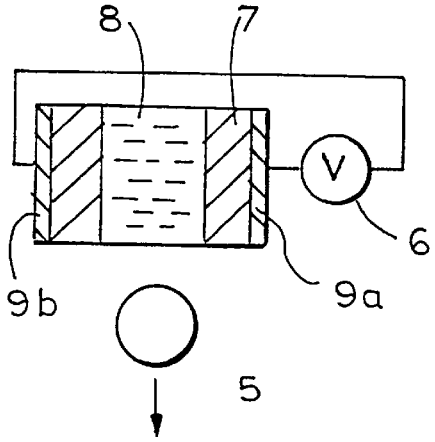
FIG. 5C is a sectional view showing how the piezoelectric element block in FIG. 5A is mechanically deformed when an electric voltage is applied to the block.

Polarization representing the characteristics of the piezoelectric element 1 is parallel to the axial direction of the through bore 2. Therefore, when an electric voltage is applied between electrodes 3*a* and 3*b* by the drive circuit 6, the piezoelectric element 1 expands in the axial direction of the through bore 2, as shown in FIG. 4C. At the same time, the through bore 2 is constricted, so a pressure wave is produced. This pressure wave propagates toward the opposite ends of the through bore 2. Consequently, a droplet of ink 5 is forcibly ejected from one end of the through bore 2. The pressure wave also propagates through the ink chamber 26, but it is absorbed in the ink chamber and does not influence other members. From the above description, it will be understood that the piezoelectric elements 20 and 21 function both as a pressure chamber and a nozzle. FIG. 5A is a perspective view showing a second example of the piezoelectric element block that is used in the printing head shown in FIG. 2, and FIG. 5B is a sectional view of the piezoelectric element block taken substantially along line D—D of FIG. 5A. In the figures, a piezoelectric element block 20A comprises a piezoelectric element 7 provided at its center with a through bore 8 having at diameter of 20 to 100 $\mu$m, and electrodes 9*a* and 9*b* on the opposite ends of the piezoelectric element in the direction perpendicular to the axial direction of the bore 8. The through bore 8 communicates with the ink chamber 26, as in the case of piezoelectric element blocks 20 and 21. Polarization of the piezoelectric element 7 is perpendicular to the polarization direction of the piezoelectric element 1, and the axial direction of the through bore 8 is perpendicular to the polarization direction of the piezoelectric element 7. Therefore, when an electric voltage is applied between the electrodes 9*a* and 9*b* by the drive circuit 6, the piezoelectric element 7 expands in the direction parallel to the axial direction of the through bore 8, as shown in FIG. 5C. At the same time, the through bore 8 is constricted, so a pressure wave is produced. This pressure wave propagates toward the opposite ends of the through bore 8. Consequently, a droplet of ink is ejected forcibly from one end of the through bore 8.

Figure 6:
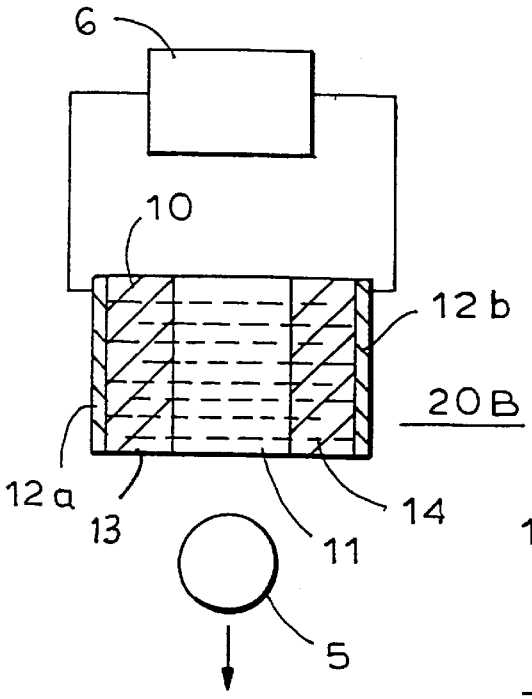
FIG. 6 is a sectional view showing a third example of the piezoelectric element block.

FIG. 6 is a sectional view showing a third example of the piezoelectric element block shown in FIG. 2. In the figure, a piezoelectric element block 20B comprises a stacked piezoelectric element 10 provided at its center with a through bore 11 having a diameter of 20 to 100 $\mu$m, common electrodes 12*a* and 12*b* on the opposite ends of the stacked piezoelectric element 10, and a plurality of electrodes 13 and 14. The piezoelectric element block 20B is 1 to 2 mm thick. The stacked piezoelectric element 10 is one in which electrodes 13 and 14 are alternately formed at predetermined spaces in the stacked piezoelectric ceramic, as shown in FIG. 6. One end of the electrode 13 is connected to the common electrode 12*a*, and one end of the electrode 14 is connected to the common electrode 12*b*. Polarization of the stacked piezoelectric element 10 is the same as that of the piezoelectric element 1. Therefore, when an electric voltage is applied between the common electrodes 12*a* and 12*b* by the drive circuit 6, the stacked piezoelectric element 10 expands in the direction parallel to the axial direction of the through bore 11. At the same time, the through bore 11 is constricted, so a pressure wave is produced. This pressure wave propagates toward the opposite ends of the through bore 11. Consequently, a droplet of ink 5 is forcibly ejected from one end of the through bore 11. The piezoelectric element block 20B can be driven with a lower drive electric voltage than the piezoelectric element block 20 of FIG. 4A, and can strengthen the ejection force of the droplet of ink 5.

Figure 7:
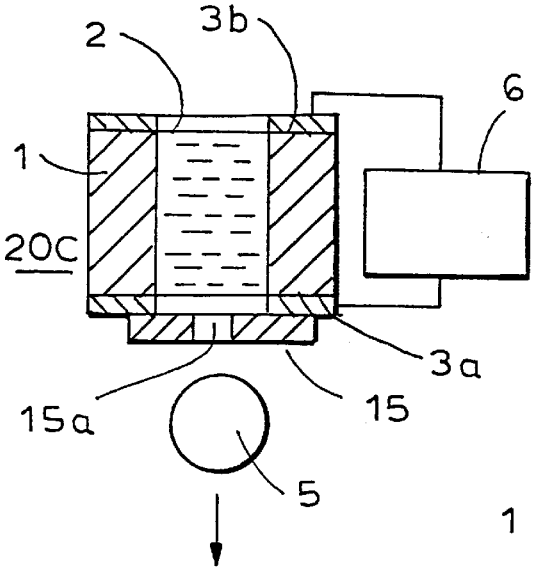
FIG. 7 is a sectional view showing a fourth example of the piezoelectric element block.

FIG. 7 is a sectional view showing a fourth example of the piezoelectric element block shown in FIG. 2. In the figure, a piezoelectric element block 20C is one in which a nozzle plate 15 is fixed on the electrode 3*a* on the ejection side of the piezoelectric element block 20 shown in FIG. 4B. The nozzle plate 15 is formed with a small bore 16*a* whose diameter is smaller than that of the through bore 2. The small bore 16*a* of the nozzle plate 15 is disposed coaxially with the through bore 2. The nozzle plate 15 makes a droplet of ink smaller and therefore has an effect of strengthening pressure for ejecting a droplet of ink.

Figure 8:
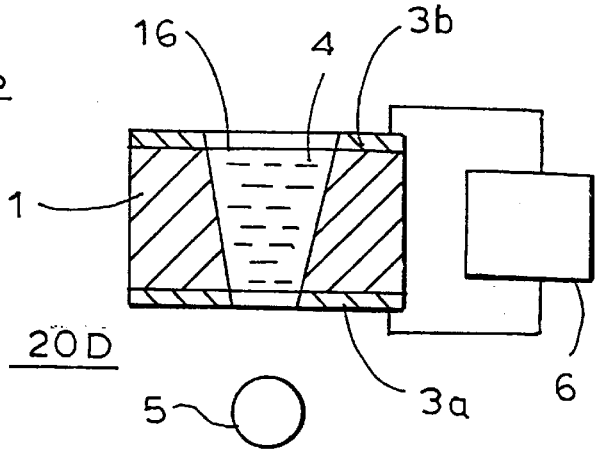
FIG. 8 is a sectional view showing a fifth example of the piezoelectric element block.

FIG. 8 is a sectional view showing a fifth example of the piezoelectric element block. In the figure, a piezoelectric element block 20D is substantially identical to the piezoelectric element block 20 shown in FIG. 4B, except that the diameter of a through bore 16 gradually varies from one of the piezoelectric element 1 to the other end. The diameter of the through bore 16 is gradually reduced toward the ejection side of the piezoelectric element 1.

Figure 9:
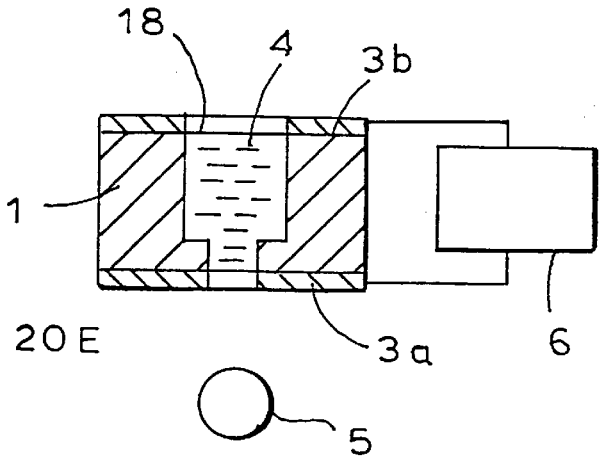
FIG. 9 is a sectional view showing a sixth example of the piezoelectric element block.

FIG. 9 is a sectional view showing a sixth example of the piezoelectric element block. In the figure, a piezoelectric element block 20E is substantially identical to the piezoelectric element block 20 shown in FIG. 4B, except that there is provided a stepped through bore 18. The stepped through bore 18 comprises a small diameter formed at the ink ejection side, and a large diameter communicating with the small diameter portion. Both piezoelectric element blocks of FIGS. 8 and 9 make a droplet of ink smaller and are therefore able to strengthen pressure for ejecting a droplet of ink.

The piezoelectric element used in the aforementioned piezoelectric element blocks 20, 20A, 20B, 20C, 20D, and 20E uses titanic acid zirconic acid lead system ceramic or titanic acid barium. The aforementioned through bore is precisely formed by means of a laser beam.

While, in the ink-jet printing head in FIG. 2, two piezoelectric element blocks have been fixed on the ink supply member 23, in three or more piezoelectric element blocks may also be fixed. In such a case, the arrangement of each piezoelectric element block is not limited to one row but may be more than one row.

Figure 10:
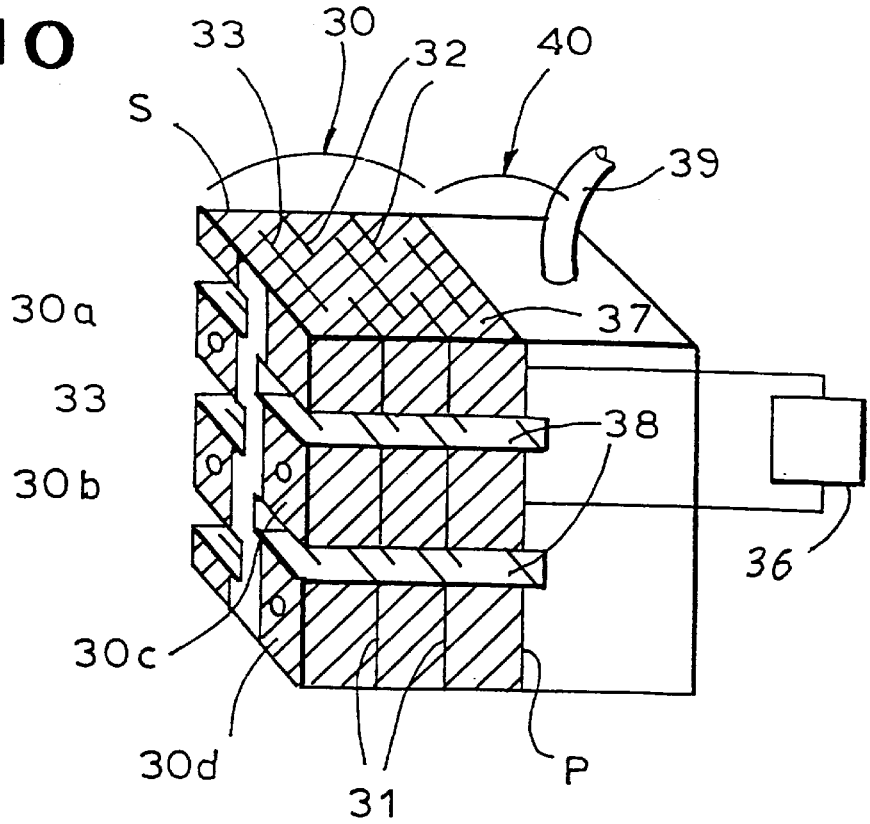
FIG. 10 is a perspective view showing an ink-jet printing head in accordance with a second embodiment of the present invention.

FIG. 10 is a perspective view showing an ink-jet printing head in accordance with a second embodiment of the present invention. In the figure, the ink-jet printing head comprises a piezoelectric element block group 30, and an ink supply member 40 provided inside it. Ink is supplied from an ink reservoir (not shown) to the ink chamber of the ink supply member 40 through a pipe 39, and flows from the ink chamber into the piezoelectric element block group 30.

The piezoelectric element block group 30 comprises piezoelectric element blocks 30*a,* 30*b,* 30*c,* and 30*d,* each of which is constituted by six-layers stacked piezoelectric elements. Each of the piezoelectric element blocks 30*a,* 30*b,* 30*c,* and 30*d* is formed at its center with a through bore from which ink is ejected and which communicates with the ink chamber of the ink supply member 40. An outer electrode of the piezoelectric element block 30 is formed on a surface (hatched portion in FIG. 10) other than the center surface 35 on the ink ejection side, on the bottom surface, on a surface to be connected to the ink supply member 40, and on a surface in which a groove 38 is formed. A plurality of inner electrodes 31, 32 and 33 is formed in the layer of each piezoelectric element block.

The electrodes 31 and 32 extend inward from the opposite side P and S of each piezoelectric element block. Three electrodes 33 are formed between electrodes 31 and 32 and do not contact side P and S. These electrodes are manufactured during the manufacture of the piezoelectric element block group 30.

Figure 11:
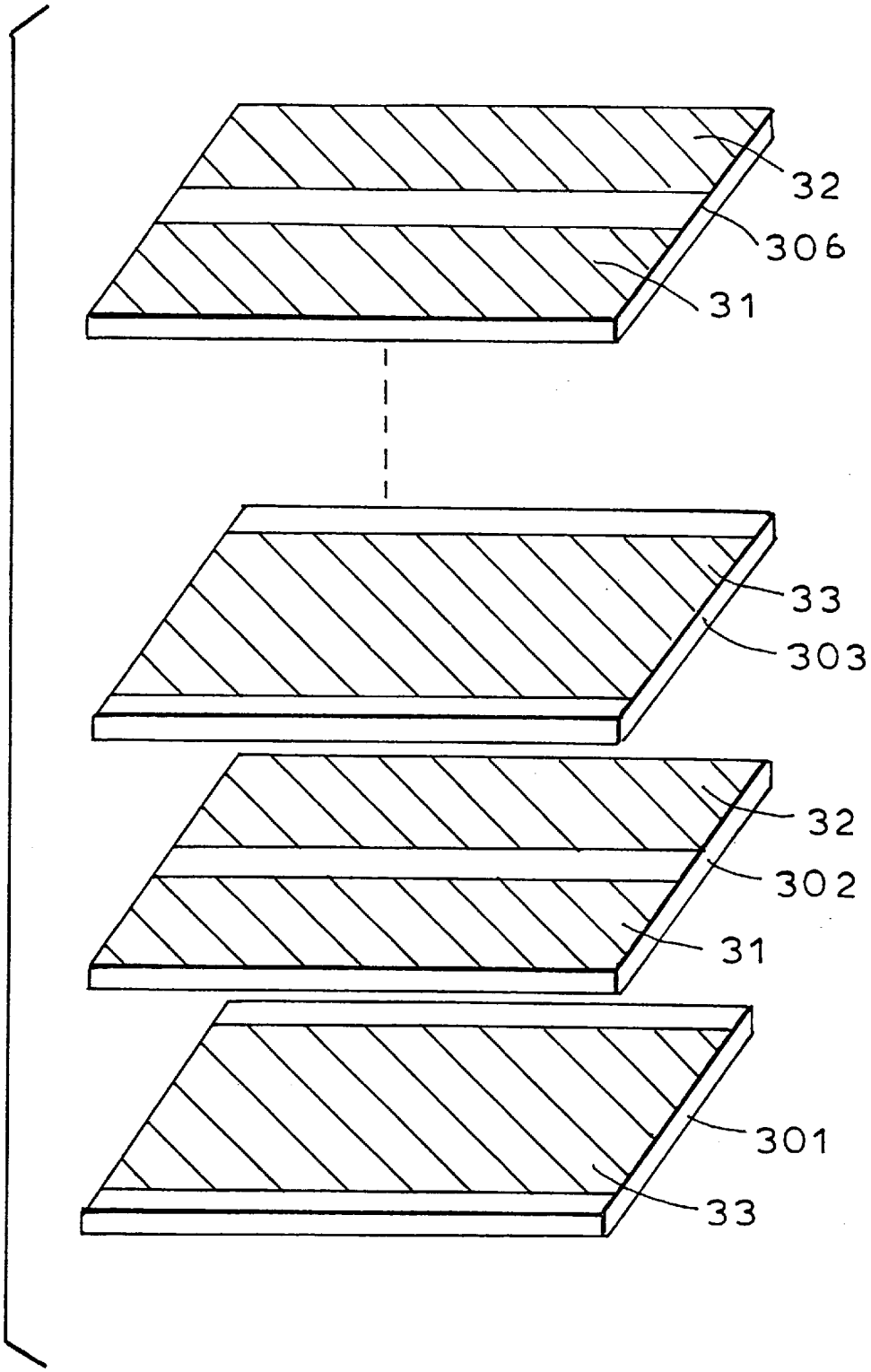
FIG. 11 is an exploded perspective view of the piezoelectric element block group of the ink-jet printing head shown in FIG. 10.

In the manufacture of the piezoelectric element block group 30, first, a first piezoelectric element layer 301, a second piezoelectric element layer 302, a third piezoelectric element layer 303, a fourth piezoelectric element layer (not shown), a fifth piezoelectric element layer (not shown), and a sixth piezoelectric element layer 306 are fabricated, as shown in FIG. 11. In the stage in FIG. 11, each piezoelectric element has not been calcined. On one surface of the first layer piezoelectric element 301, there is formed an electrode 33. On one surface of the second layer piezoelectric element 302, there are formed electrodes 31 and 32. On one surface of the third layer piezoelectric element 303, there is formed an electrode 33. Likewise, for the fourth to sixth layer piezoelectric elements, electrodes 31, 32 and the electrode 33 are alternately formed. Each electrode is formed by printing.

Next, the first 301 to sixth 306 layer piezoelectric elements are stacked and calcined. After calcination, an electrode film is formed on a surface other than the bottom surface of FIG. 10 and the surface to be bonded to the ink supply 40. The electrode film is electrically coupled with electrodes 31, 32 and 33.

Finally, a plurality of grooves 38 is formed by means of a cutter, and piezoelectric element blocks 30*a*, 30*b*, 30*c* and 30*d* are formed. The through bores of the piezoelectric element blocks 30*a,* 30*b,* 30*c,* and 30*d* are formed after the formation of grooves 38. Alternatively, they may be formed in advance in each piezoelectric element in FIG. 11.

When a drive signal from the drive circuit 36 is supplied to electrodes 32 and 33, piezoelectric element blocks 30*a* and 30*b* are driven. Likewise, when a drive signal from the drive circuit 36 is supplied to electrodes 31 and 33, piezoelectric element blocks 30*c* and 30*d* are driven. Electrodes 31 and 32 of each piezoelectric element block are connected to the drive circuit 36 through the electrode surface of the block side, while the electrode 33 inside each piezoelectric element is connected to the drive circuit 36 through the common electrode surface 37. Upon the drive signal, a droplet of ink is ejected from piezoelectric element blocks 30*a,* 30*b,* 30*c,* and 30*d* in the same manner as the piezoelectric element block 20B in FIG. 6.

In this embodiment, a plurality of piezoelectric element blocks can be manufactured at once and bonded at once, so that a printing head is obtained in which manufacturing processes are fewer and manufacturing cost is low. In addition, one electrode 33 of each piezoelectric element block is connected to the common electrode 37, so that wiring is not complicated.

Figure 12:
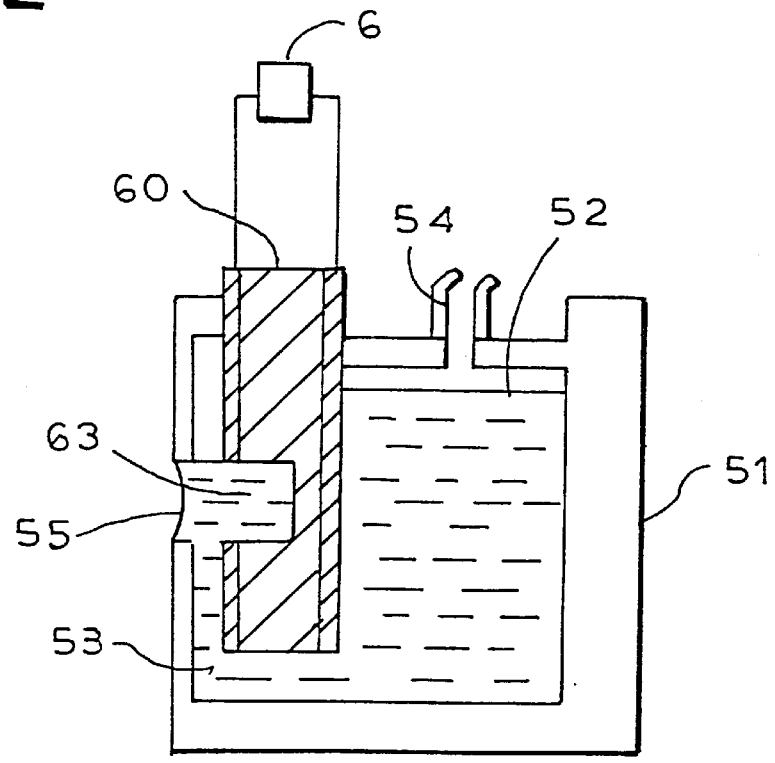
FIG. 12 is a perspective view showing an ink-jet printing head in accordance with a third embodiment of the present invention.

FIG. 12 is a perspective view showing an ink-jet printing head in accordance with a third embodiment of the present invention. In the figure, a piezoelectric element block 60 is disposed in an ink chamber 52 of an ink supply member 51. Ink is supplied from a pipe 54 to the ink chamber 52. The ink supply member 51 is formed with a circular nozzle 55 from which a droplet of ink is ejected. The piezoelectric element block 60 is disposed near the nozzle 55 through a gap 53. The gap is provided so that the ink in the ink chamber 53 is supplied to a bore 63 of the piezoelectric element block 60 by capillary action and is 20 $\mu$m.

Figure 13A:
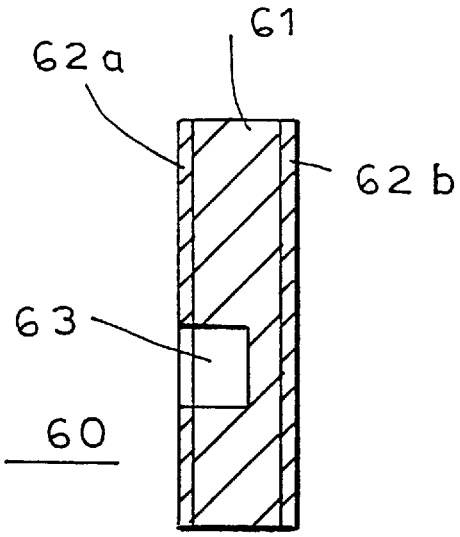
FIG. 13A is a sectional view of the ink-jet printing head in FIG. 12.
Figure 13B:
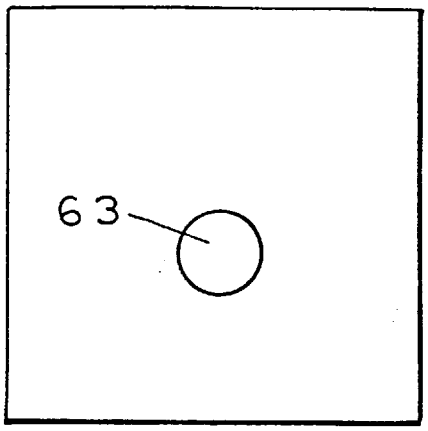
FIG. 13B is a plan view of the ink-jet printing head of FIG. 13A.

As shown in FIGS. 13A and 13B, the piezoelectric element block 60 comprises a piezoelectric element 61 formed at its center with a blind bore 63 of diameter 20 to 100 $\mu$m, and electrodes 62*a* and 62*b* formed on both surfaces of the piezoelectric element 61. Electrodes 62*a* and 62*b* are connected to the drive circuit 6. Since the piezoelectric element 60 is immersed in the ink chamber, electrodes are covered with a protection insulating film. When a drive signal is supplied to electrodes 62*a* and 62*b,* the piezoelectric element 61 expands in the axial direction of the bore 63 and, therefore, the diameter of the bore 63 is constricted so that a pressure wave is produced. This pressure wave propagates toward the outlet of the bore 63. Consequently, a droplet of ink is forcibly ejected from the outlet of the bore 63. As clearly shown in FIG. 12, ink is always supplied to the bore 63 through the gap 53, and the nozzle 52 is disposed in front of the bore 63 through the gap 53. Therefore, if, upon a drive signal, the pressure wave propagates toward the nozzle, a droplet of ink will be ejected from the nozzle 52.

This embodiment has the advantage that the printing head can be made smaller than those of the other embodiments, because the piezoelectric element block 60 is disposed inside the ink supply.

Figure 14A:
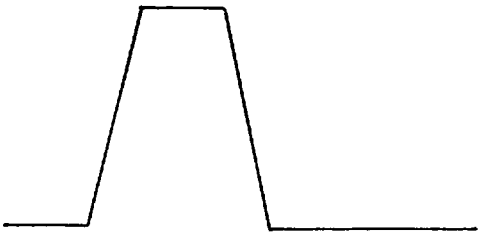
FIGS. 14A and 14B are waveform diagrams showing a pulse waveform of a drive signal to be supplied to the printing head.
Figure 14B:
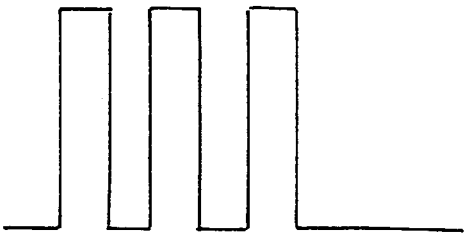

In the ink-jet printing heads described above, the drive circuit for driving the piezoelectric element block may use a signal having a single pulse such as that shown in FIG. 14A, upon which a droplet of ink is ejected. Alternatively, a signal having a plurality of pulses such as that shown in FIG. 14B may be used. In the case of FIG. 14B, the pulse cycle is set so that it is integer times the number of natural oscillations of the piezoelectric element.

While the present invention has been described with relation to the preferred embodiments, various modifications and adaptations thereof will now be apparent to those skilled in the art. For example, although the shape of the piezoelectric element block in each embodiment has been a rectangular parallelepiped, it may be a cylinder. Also, although the ink supply and piezoelectric element block have been bonded by means of an adhesive, they may also be bonded by ceramic calcination. It is very important for the piezoelectric element block to have a pressure chamber.

What is claimed is:

1. An ink-jet printing head comprising:

a plurality of piezoelectric element blocks, each of said blocks having opposite ends, a bore extending in an axial direction for storing ink, and electrodes disposed on said opposite ends, said opposite ends being disposed in a direction perpendicular to the axial direction; and an ink supply member fixed to one of said opposite ends of each of said piezoelectric element blocks for supplying said ink to said bore of each of said blocks, said ink supply member having at least one groove therein;

wherein each of said piezoelectric element blocks is separated from another of said piezoelectric element blocks by one said groove which is between said piezoelectric element blocks so that mechanical deformation of one of said piezoelectric element blocks does not have an affect on another of said piezoelectric element blocks and each of said piezoelectric element blocks ejects a droplet of ink from said bore at another of said two ends by a mechanical deformation produced when an electric voltage is supplied to said electrodes.

2. The ink-jet printing head as set forth in claim 1, wherein each said bore is comprises a through bore.

3. The ink-jet printing head as set forth in claim 1, wherein said electrodes are common electrodes, each of said piezoelectric element blocks is a stacked piezoelectric element block which has predetermined spaces therein and a plurality of electrodes alternately positioned at said predetermined spaces, and each of said plurality of electrodes is connected to one of said common electrodes.

4. The ink-jet printing head as set forth in claim 1, wherein each said bore has an ink ejection side, and a nozzle is fixed on said ink ejection side of said bore of said piezoelectric element block.

5. The ink-jet printing head as set forth in claim 1, wherein said bore of each of said piezoelectric element block has a diameter which is gradually reduced in a direction of ink ejection.

6. The ink-jet printing head as set forth in claim 1, wherein said ink supply member has an ink chamber for storing said ink that is supplied to said bore of each of said piezoelectric element blocks.

* * * * *